US006761529B2

(12) United States Patent
Soechting et al.

(10) Patent No.: US 6,761,529 B2
(45) Date of Patent: Jul. 13, 2004

(54) COOLING STRUCTURE OF STATIONARY BLADE, AND GAS TURBINE

(75) Inventors: Friedrich Soechting, Miami, FL (US); Satoshi Hada, Takasago (JP); Masamitsu Kuwabara, Takasago (JP); Junichiro Masada, Takasago (JP); Yasuoki Tomita, Takasago (JP)

(73) Assignee: Mitshubishi Heavy Industries, Ltd., Tokyo (JP)

( * ) Notice: Subject to any disclaimer, the term of this patent is extended or adjusted under 35 U.S.C. 154(b) by 40 days.

(21) Appl. No.: 10/202,654

(22) Filed: Jul. 25, 2002

(65) Prior Publication Data

US 2004/0018082 A1 Jan. 29, 2004

(51) Int. Cl.[7] ..... F01D 9/06
(52) U.S. Cl. ..... 415/115; 416/96 R
(58) Field of Search ..... 415/115, 116, 415/173.7; 416/96 R, 97 R

(56) References Cited

U.S. PATENT DOCUMENTS 5,399,065 A * 3/1995 Kudo et al. ..... 415/115
5,609,466 A * 3/1997 North et al. ..... 415/115
5,997,245 A * 12/1999 Tomita et al. ..... 415/115
6,036,436 A * 3/2000 Fukuno et al. ..... 415/115
6,079,946 A * 6/2000 Suenaga et al. ..... 416/97 R
6,099,244 A * 8/2000 Tomita et al. ..... 415/115
6,210,111 B1 * 4/2001 Liang ..... 415/115
6,241,467 B1 * 6/2001 Zelesky et al. ..... 415/115
6,264,426 B1 * 7/2001 Fukuno et al. ..... 415/115

FOREIGN PATENT DOCUMENTS

JP 10-220203 8/1998
JP 11-132005 5/1999

* cited by examiner

*Primary Examiner*—Edward K. Look
*Assistant Examiner*—Richard Edgar
(74) *Attorney, Agent, or Firm*—Oblon, Spivak, McClelland, Maier & Neustadt, P.C.

(57) ABSTRACT

A collision plate having plural small holes is provided at an interval from a bottom surface of an inner shroud to form a chamber and guides cooling air from the small holes into the chamber. A leading edge flow path is provided at a leading edge side along a width direction and introduces the cooling air. A side flow path is provided along both sides of the inner shroud and guides the cooling air to a trailing edge side. A header is formed along the width direction near the trailing edge and guides the cooling air from the side flow path. Plural trailing edge flow paths are formed at the trailing edge side at intervals along a width direction, in which one end of each flow path is connected to the header and the other end is open at the trailing edge, and the cooling air in the header is ejected from the trailing edge.

6 Claims, 7 Drawing Sheets

COOLING STRUCTURE OF STATIONARY BLADE, AND GAS TURBINE

BACKGROUND OF THE INVENTION

1. Field of the Invention

The present invention relates to a cooling system of a stationary blade of a gas turbine, in particular, a cooling system of a stationary blade having superior cooling efficiency, and to a gas turbine.

2. Description of Related Art

A gas turbine used for a generator and the like is shown in FIG. 4.

Compressor 1, combustor 2, and turbine 3 are shown in FIG. 4, and rotor 4 extends from compressor 1 to turbine 3 in the axial direction.

Inner housing 6, and cylinders 7 and 8 provided at the compressor 1 side enclose the outside of compressor 1. Furthermore, cylindrical shell 9 forming chamber 14, outside shell 10 of turbine 3, and inside shell 11 are provided in the gas turbine.

Inside of cylinder 8 which is provided in compressor 1, stationary blades 12 are disposed in the circumferential direction at equal intervals. Moving blades 13, which are disposed around rotor 4 at equal intervals, are disposed between stationary blades 12.

Combustor 15 is disposed in chamber 14 which is enclosed by cylindrical shell 9. Fuel supplied from fuel feeding pipe 35 is injected from fuel injection nozzle 34 into combustor 15 to burn.

A high temperature combustion gas generated in combustor 15 is introduced into turbine 3 while passing through duct 16.

In turbine 3, two-stage type stationary blades 17, which are disposed in the circumferential direction at equal intervals on inside shell 11, and moving blades 18, which are disposed in the circumferential direction at equal intervals on rotor 4, are alternately provided in the axial direction. The high temperature combustion gas is fed into turbine 3 and is discharged as an expanded gas, and further, the high temperature combustion gas rotates rotor 4 on which moving blades 18 are fixed.

Manifolds 21 and 22 are provided in compressor 1 and turbine 3 respectively. Manifolds 21 and 22 are connected with each other by air piping 32, and cooling air is supplied from the compressor 1 side to the turbine 3 side via air piping 32.

A portion of cooling air from compressor 1 is supplied from a rotor disc to moving blades 18 in order to cool moving blades 18. As shown in FIG. 4, a portion of cooling air from manifold 21 of compressor 1 passes through air piping 32 and is introduced into manifold 22 of turbine 3 to cool stationary blades 17, and simultaneously, the cooling air is supplied as sealing air.

Next, a structure of stationary blades 17 will be explained below.

In FIG. 5, inner shroud 26 and outer shroud 27 are provided at the inside and the outside of blade 25 respectively.

Inside of blade 25, leading edge path 42 and trailing edge path 44 are formed by rib 40. Cylindrical insert parts 46 and 47, in which plural cooling air holes 70, 71, 72, and 73 are formed at the peripheral surfaces and bottom surfaces, are inserted from the outer shroud 27 side into the leading edge path 42 and trailing edge path 44.

Blade 25 is equipped with pin fin cooling part 29 comprising a flow path having plural pins 62 at the trailing edge side.

When cooling air is supplied from manifold 22 into insert parts 46 and 47, the cooling air is ejected from cooling air holes 70, 71, 72, and 73, and hits the inner walls of leading edge path 42 and trailing edge path 44 to carry out so-called impingement cooling. Furthermore, the cooling air flows through pin fin cooling part 29 comprising flow paths formed between plural pins 62 at the trailing edge side of blade 25 to carry out pin fin cooling.

On inner shroud 26, forward flange 81 and rearward flange 82 are formed at the leading edge side and the trailing edge side, and are connected to seal supporting part 66, which supports seal 33 for sealing arm 48 of rotor 4 and seal supporting part 66. Furthermore, cavity 45 is formed between seal supporting part 66 and inner shroud 26. The cooling air ejected from cooling air holes 70, 71, 72, and 73 of insert parts 46 and 47 is supplied into cavity 45.

Flow path 85 is formed at the forward side of seal supporting part 66. Air is injected from cavity 45 while passing through flow path 85 toward the front stage moving blade 18 and toward the rear stage moving blade while passing through spaces formed in seal 33, and the inside is maintained at a pressure higher than that of a path of high temperature combustion gas in order to prevent high temperature combustion gas from penetrating to the inside.

As shown in FIGS. 6 and 7, leading edge flow path 88 equipped with plural needle fins 89 is formed at the leading edge side of inner shroud 26. Leading edge flow path 88 is connected to cavity 45 via flow path 90. Rails 96 are formed along the leading edge toward the trailing edge at both sides of inner shroud 26. In each rail 96, flow path 93 is formed in which one end of each rail 96 is connected to leading edge flow path 88 and the other end of each rail 96 opens at the trailing edge of inner shroud 26.

On the bottom surface of inner shroud 26, collision plates 84 having plural small holes 101 are provided at an interval from the bottom surface. By providing these collision plates 84, chamber 78 is formed at the bottom surface side of inner shroud 26.

Furthermore, at the trailing edge side of inner shroud 26, plural flow paths 92 are formed so as to be connected to the trailing edge of inner shroud 26 and chamber 78.

Cooling air flowing into cavity 45 is injected into leading edge flow path 88 of inner shroud 26 via flow path 90, passes through the space between needle fins 89 to cool the leading edge side of inner shroud 26, and subsequently passes through side flow path 93 to be ejected from the trailing edge of inner shroud 26.

Moreover, cooling air flowing into cavity 45 flows into chamber 78 from small holes 101 and passes through flow path 92 to be ejected from the trailing edge of inner shroud 26. When cooling air flows into chamber 78 from small holes 101 of collision plate 84, cooling air hits the bottom surface of inner shroud 26, carrying out impingement cooling. Due to impingement cooling, cooling air passes through plural flow paths 92 to cool the trailing edge side of inner shroud 26.

As shown in FIG. 8, collision plates 102 having plural small holes 100 are provided at the upper surface of outer shroud 27 at an interval from the upper surface. By providing these collision plates 102, chamber 104 (not shown) is formed at the upper surface side of outer shroud 27.

Leading edge flow path 105 is formed in outer shroud 27, and side flow path 106, which opens at the trailing edge of outer shroud 27, is formed at both sides thereof. Leading edge flow path 105 is connected to one chamber 104.

Furthermore, at the trailing edge side of outer shroud 27, plural flow paths 107 are formed so as to be connected to the trailing edge of outer shroud 27 and chamber 104.

Cooling air flowing into manifold 22 flows into chamber 104 from small holes 100 of collision plate 102 and passes through trailing edge flow path 107 to be ejected from the trailing edge of outer shroud 27. When cooling air flows into chamber 104 from small holes 100 of collision plate 102, cooling air hits the upper surface of outer shroud 27, carrying out impingement cooling.

Furthermore, cooling air flowing into chamber 104 flows into leading edge flow path 105 and passes through leading edge flow path 105 and side flow paths 106 to cool the leading edge and both sides of outer shroud 27. Subsequently, cooling air is ejected from the trailing edge of outer shroud 27.

As described above, in stationary blades of this type of gas turbine, the blade metal temperature is maintained at an allowable temperature or less using various cooling techniques, such as impingement cooling, and pin fin cooling by introducing a portion of compressed air. However, inner shroud 26 and outer shroud 27 require a large amount of air for cooling of the trailing edge side. As a result, further improvement of cooling efficiency is required.

BRIEF SUMMARY OF THE INVENTION

The present invention is conceived in view of the above-described problems and has an object of the provision of a cooling structure of a stationary blade in which the amount of cooling air is reduced to be used while significantly improving cooling efficiency, and of the provision of a gas turbine.

In order to solve the problems, a first aspect of the present invention is to provide a cooling structure of a stationary blade comprising an inner shroud and an outer shroud at the inside and outside of a blade, in which the outer shroud, the blade, and the inner shroud are cooled by cooling air to be sent to the outer shroud side. A cavity is formed at an inner surface of the inner shroud into which cooling air passing through the blade is sent. The inner shroud comprises: a collision plate having plural small holes which is provided at an interval from the bottom surface to form a chamber between the bottom surface and the collision plate, for guiding the cooling air in the cavity from the small holes into the chamber; a leading edge flow path provided at a leading edge side along a width direction for guiding the cooling air in the chamber; a side flow path provided along both sides for guiding the cooling air in the leading edge flow path to a trailing edge side; a header formed along the width direction near the trailing edge for feeding the cooling air from the side flow path; and plural trailing edge flow paths formed at intervals along the width direction at the trailing edge side, each having one end connected to the header and the other end being open at the trailing edge, for ejecting the cooling air in the header from the trailing edge.

In the above-described cooling structure of a stationary blade, the outer shroud may comprise: a collision plate having plural small holes which is provided at an upper surface of the outer shroud at an interval to form a chamber between the upper surface and the collision plate; a leading edge flow path provided at a leading edge side along a width direction for guiding cooling air in the chamber; a side flow path provided along both sides for guiding the cooling air in the leading edge flow path to a trailing edge side; a header formed along the width direction near the trailing edge for feeding the cooling air from the side flow path; and plural trailing edge flow paths formed at intervals along the width direction at the trailing edge side, each having one end connected to the header and the other end being open at the trailing edge, for ejecting the cooling air in the header from the trailing edge.

In the above outer shroud, plural trailing edge flow paths may be provided along the width direction at predetermined intervals.

Furthermore, a second aspect of the present invention is to provide a cooling structure of a stationary blade comprising an inner shroud and an outer shroud at the inside and outside of a blade, in which the outer shroud, the blade, and the inner shroud are cooled by cooling air to be sent to the outer shroud side. The outer shroud comprises: a collision plate having plural small holes which is provided at an interval from the upper surface to form a chamber between the upper surface and the collision plate, for guiding the cooling air from the small holes into the chamber; a leading edge flow path provided at a leading edge side along a width direction for guiding the cooling air in the chamber; a side flow path provided along both sides for guiding the cooling air in the leading edge flow path to a trailing edge side; a header formed along the width direction near the trailing edge for feeding the cooling air from the side flow path; and plural trailing edge flow paths formed at intervals along the width direction at the trailing edge side, each having one end connected to the header and the other end being open at the trailing edge, for ejecting the cooling air in the header from the trailing edge.

In the above-described cooling structure of a stationary blade, plural trailing edge flow paths may be provided along the width direction of the outer shroud at predetermined intervals.

According to the above-described cooling structure of a stationary blade, the stationary blade is cooled by allowing the cooling air from the small holes of the collision plate to flow into the chamber, passing the cooling air after being used for the impingement cooling through the leading edge side and both sides, and sending the cooling air to the trailing edge side. Therefore, in comparison with the effects of a conventional cooling structure in which the cooling air after being used for the impingement cooling is simply sent to the trailing edge side and is ejected, the amount of the consumed cooling air is largely reduced and therefore, the cooling efficiency is significantly improved.

Furthermore, the present invention provides a gas turbine having a cooling structure of a stationary blade according to any one of the above-described structures, wherein a stationary blade constitutes a turbine which rotates a rotor by means of combustion gas from a combustor.

As described above, since the gas turbine has a stationary blade having superior cooling efficiency, the amount of the consumed cooling air is largely reduced and the performance of the gas turbine is improved.

DETAILED DESCRIPTION OF THE INVENTION

A cooling structure of a stationary blade and a gas turbine of an embodiment according to the present invention are explained with reference to the figures. The parts in the cooling structure according to the present invention which are the same as the parts in the conventional cooling structure are indicated with the same numerals and their explanations are omitted.

Figure 1:
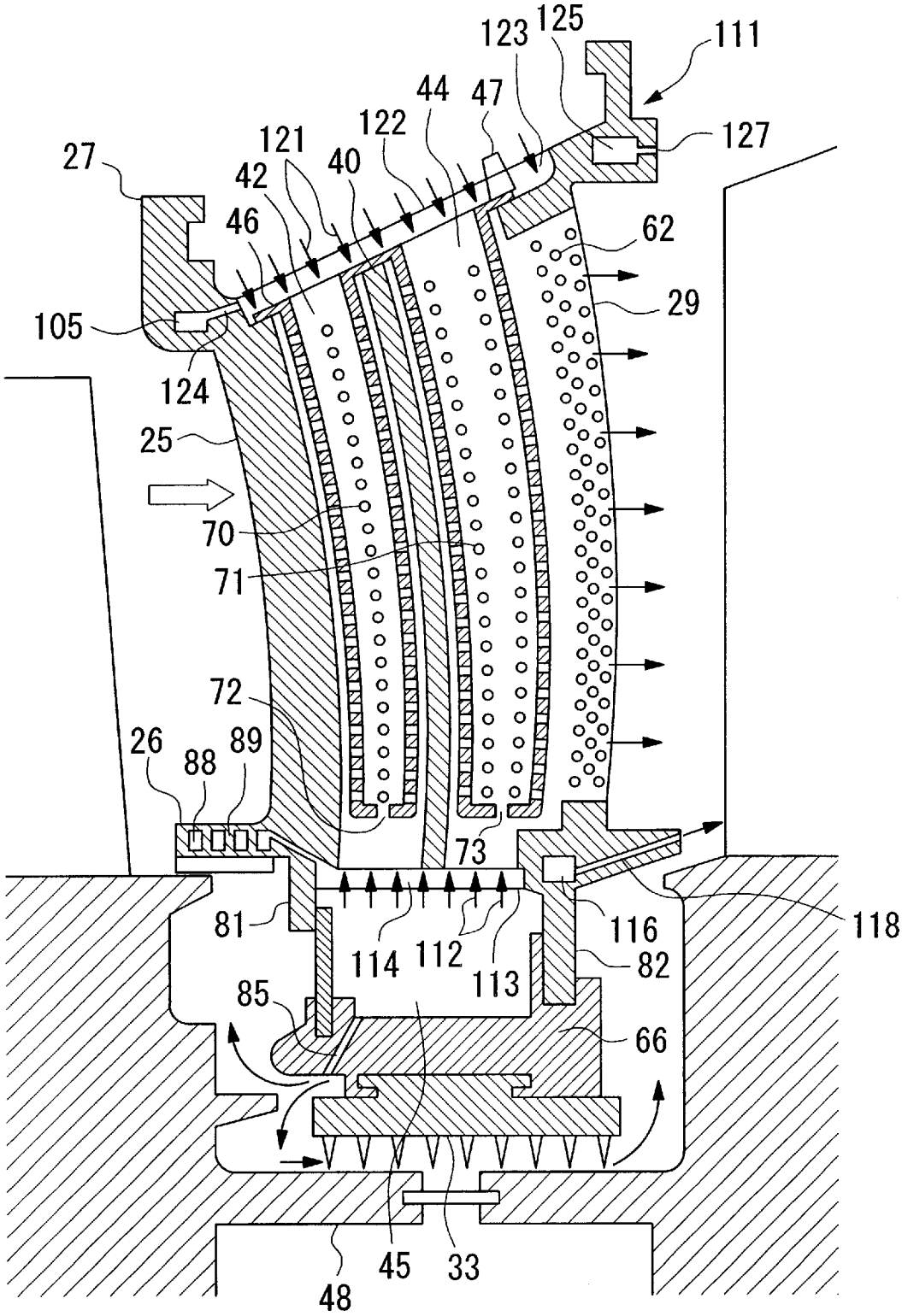
FIG. 1 is a cross-sectional view of a stationary blade for explaining a cooling structure of the stationary blade of an embodiment according to the present invention.
Figure 2:
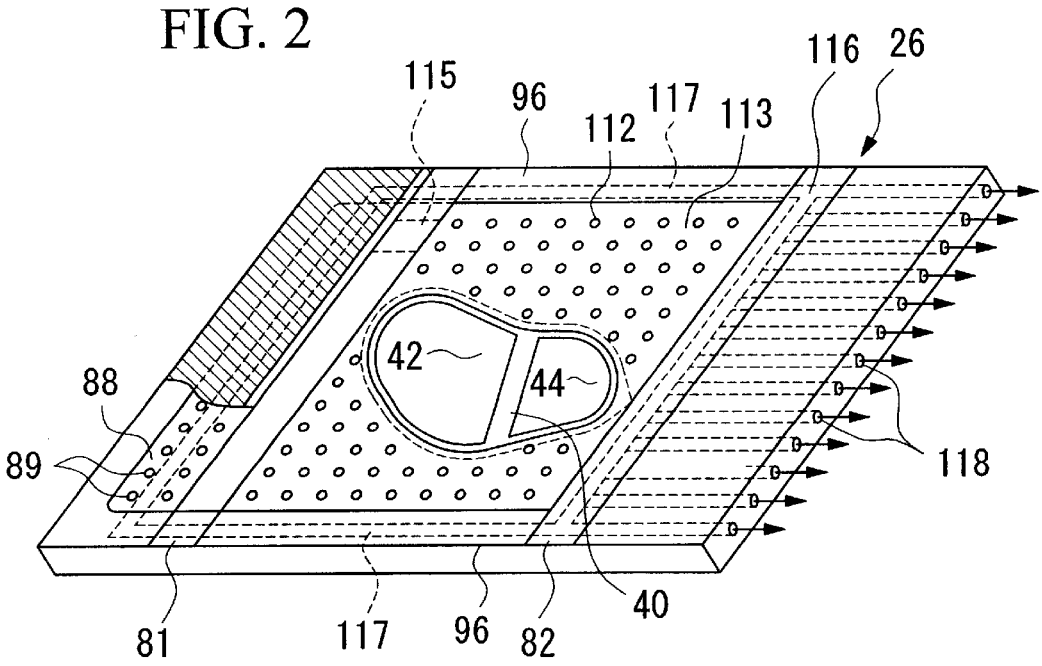
FIG. 2 is a perspective view of an inner shroud shown from the bottom surface of the inner shroud for explaining the inner shroud of a stationary blade of an embodiment according to the present invention.

FIG. 1 shows stationary blade 111 of the present embodiment. As shown in FIG. 2, collision plate 113 having plural small holes 112 is provided at an interval from the bottom surface of inner shroud 26 of stationary blade 111. By providing collision plate 113, chamber 114 is formed at the bottom surface side of inner shroud 26.

Chamber 114 is connected to leading edge flow path 88 which is formed at the leading edge side of inner shroud 26 via flow path 115.

Header 116 is formed at the trailing edge side of inner shroud 26 along the width direction. Header 116 is connected to side flow paths 117 which are formed in rails 96 of both sides of inner shroud 26 and is connected to leading edge flow path 88.

Furthermore, plural trailing edge flow paths 118 are formed at the trailing edge side of inner shroud 26 each at intervals in the width direction. Trailing edge flow paths 118 open at the trailing edge of inner shroud 26. Each trailing edge flow path 118 is connected to header 116.

Figure 3:
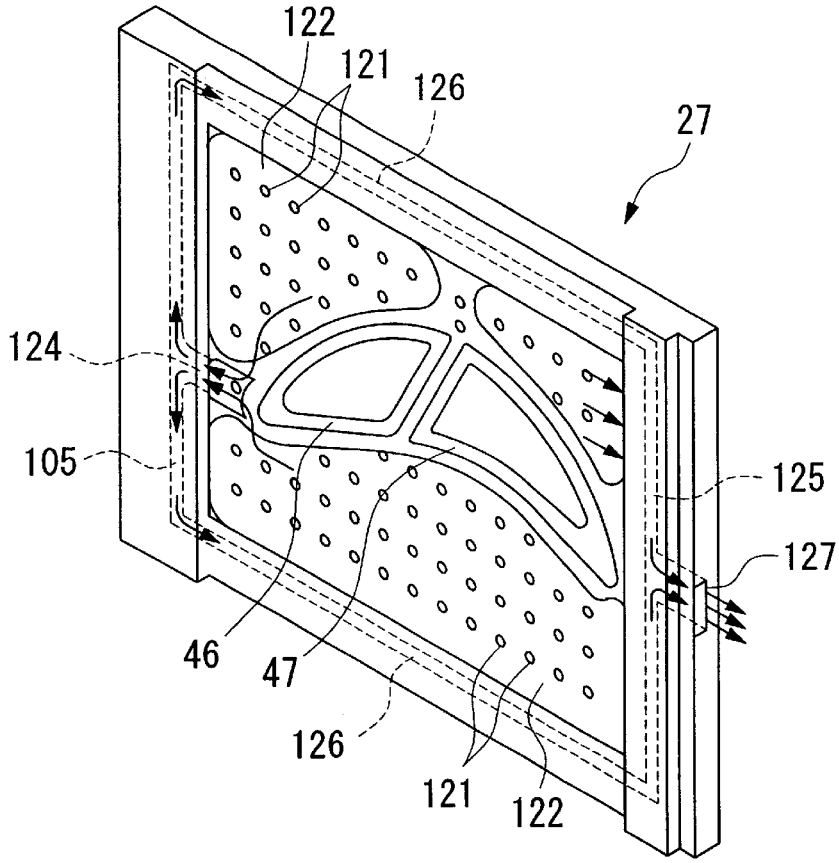
FIG. 3 is a perspective view of an outer shroud shown from the upper surface of the outer shroud for explaining the outer shroud of a stationary blade of an embodiment according to the present invention.

As shown in FIG. 3, collision plate 122 having plural small holes 121 is provided at an interval from the upper surface of outer shroud 27. By providing collision plate 122, chamber 123 is formed at the upper surface side of outer shroud 27.

Chamber 123 is connected to leading edge flow path 105 which is formed at the leading edge side of outer shroud 27 via flow path 124.

Header 125 is formed at the trailing edge side of outer shroud 27 along the width direction of outer shroud 27 and is connected to side flow paths 126 which are formed at both sides of outer shroud 27 and is connected to leading edge flow path 105.

Furthermore, trailing edge flow path 127 is formed at approximately the center of the trailing edge side of outer shroud 27. Trailing edge flow path 127 opens at the trailing edge of outer shroud 27. Trailing edge flow path 127 is connected to header 125.

Due to stationary blade 111 having inner shroud 26 and outer shroud 27, cooling air is injected from inserts 46 and 47, and from manifold 22. The cooling air is then ejected from cooling air holes 70, 71, 72, and 73, and hits the inner walls of leading edge flow path 42 and trailing edge flow path 44 to carry out impingement cooling. Furthermore, the cooling air flows through pin fin cooling part 29, which is composed of flow paths between pins 62 of the trailing edge side of blade 25, to carry out pin fin cooling.

Furthermore, the cooling air sent into cavity 45 flows from small holes 112 of collision plate 113 into chamber 114, and hits the bottom surface of inner shroud 26 to carry out impingement cooling.

Moreover, the cooling air in chamber 114 is sent from flow path 115 to leading edge flow path 88 and passes through needle fins 89 to cool the leading edge side of inner shroud 26. Subsequently, the cooling air passes through side flow paths 117, is sent to header 116, passes through plural trailing edge flow paths 118 formed in the trailing edge of inner shroud 26, and is ejected from the trailing edge to cool the trailing edge side of inner shroud 26.

The cooling air sent into manifold 22 flows from small holes 121 of collision plate 122 into chamber 123 and hits the upper surface of outer shroud 27 to carry out impingement cooling.

Subsequently, the cooling air is sent to leading edge flow path 105 via flow path 124, is sent to header 125 via side flow paths 126 provided in both sides of outer shroud 27, passes through trailing flow path 127, and is ejected from the trailing edge to cool the periphery of outer shroud 27.

The cooling air after use for the impingement cooling at the center of outer shroud 27 is sent to inserts 42 and 44 of blade 25.

According to the cooling structure of the stationary blade, in inner shroud 26 and outer shroud 27, the stationary blade is cooled by flowing the cooling air into the trailing edge while passing through the leading edge side and both sides, wherein the cooling air is sent from small holes 112 and 121 of collision plates 113 and 122 into chambers 114 and 123 to be used for impingement cooling. Therefore, in comparison with the effects of a conventional cooling structure in which the cooling air after being used for the impingement cooling is simply sent to the trailing edge side and is ejected, the amount of the consumed cooling air is largely reduced, and therefore, the cooling efficiency is significantly improved.

Furthermore, according to the gas turbine equipped with stationary blade 111 having the above-described cooling structure, the amount of the consumed cooling air for cooling stationary blade 111 is reduced, and therefore, the cooling efficiency is improved.

As described above, a two-stage type stationary blade is explained as an example, however, the type of the stationary blade is not limited to the above example.

Figure 3A:
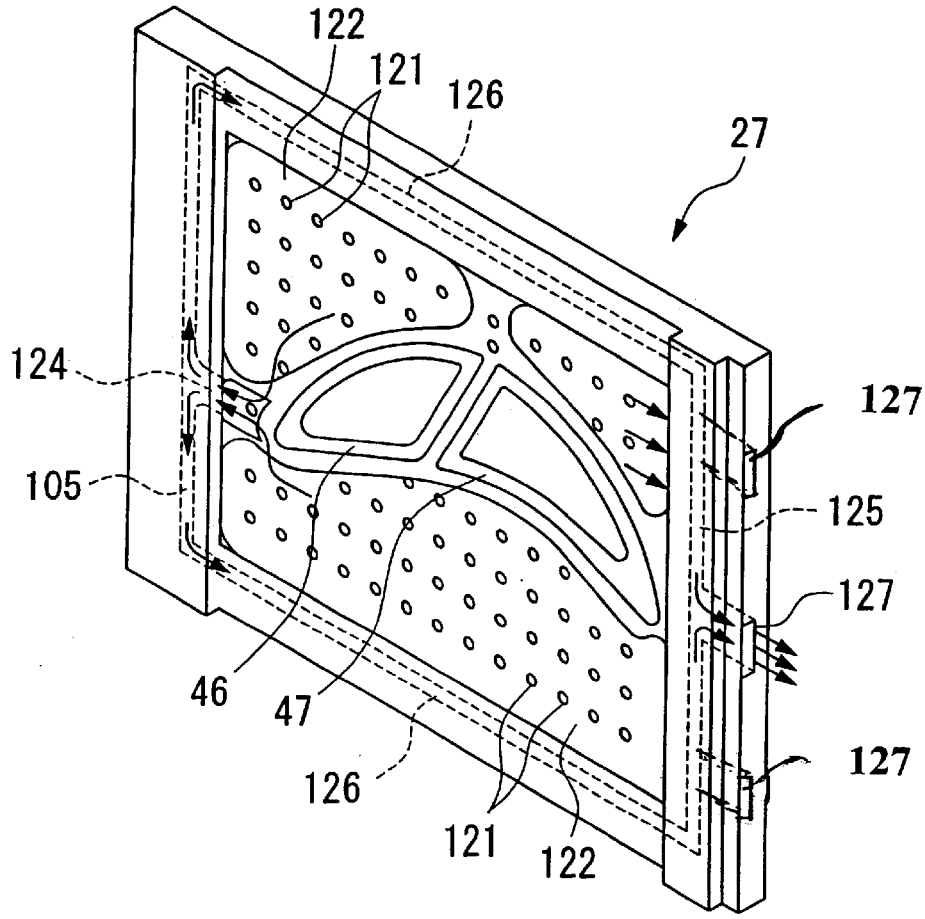
FIG. 3A is a perspective view of an outer shroud shown from the upper surface of the outer shroud for explaining the outer shroud of a stationary blade of one embodiment according to the present invention having plural trailing edge flow paths.
Figure 4:
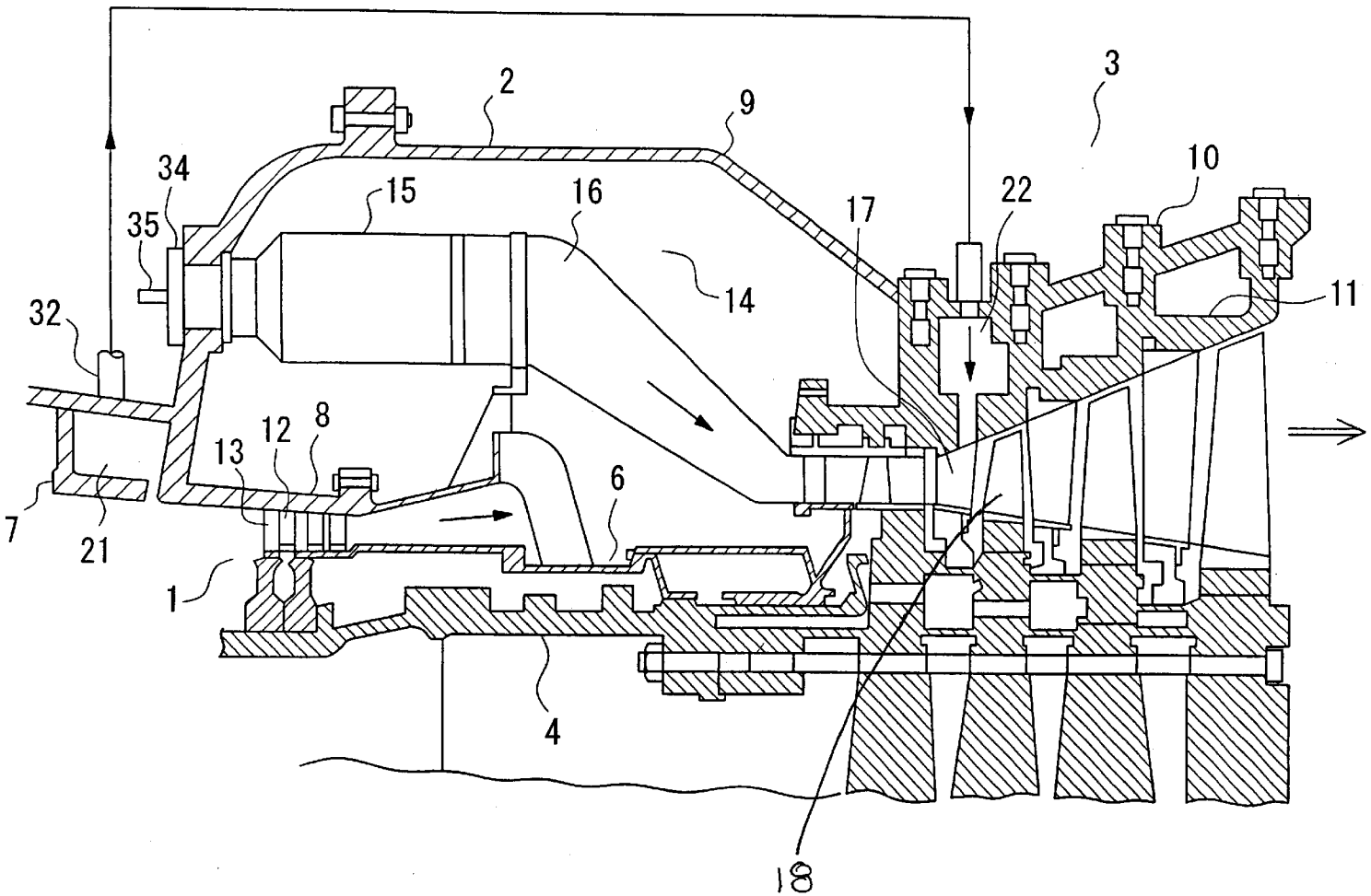
FIG. 4 is a cross-sectional view of a gas turbine for explaining a structure of the gas turbine equipped with a stationary blade according to the present invention.
Figure 5:
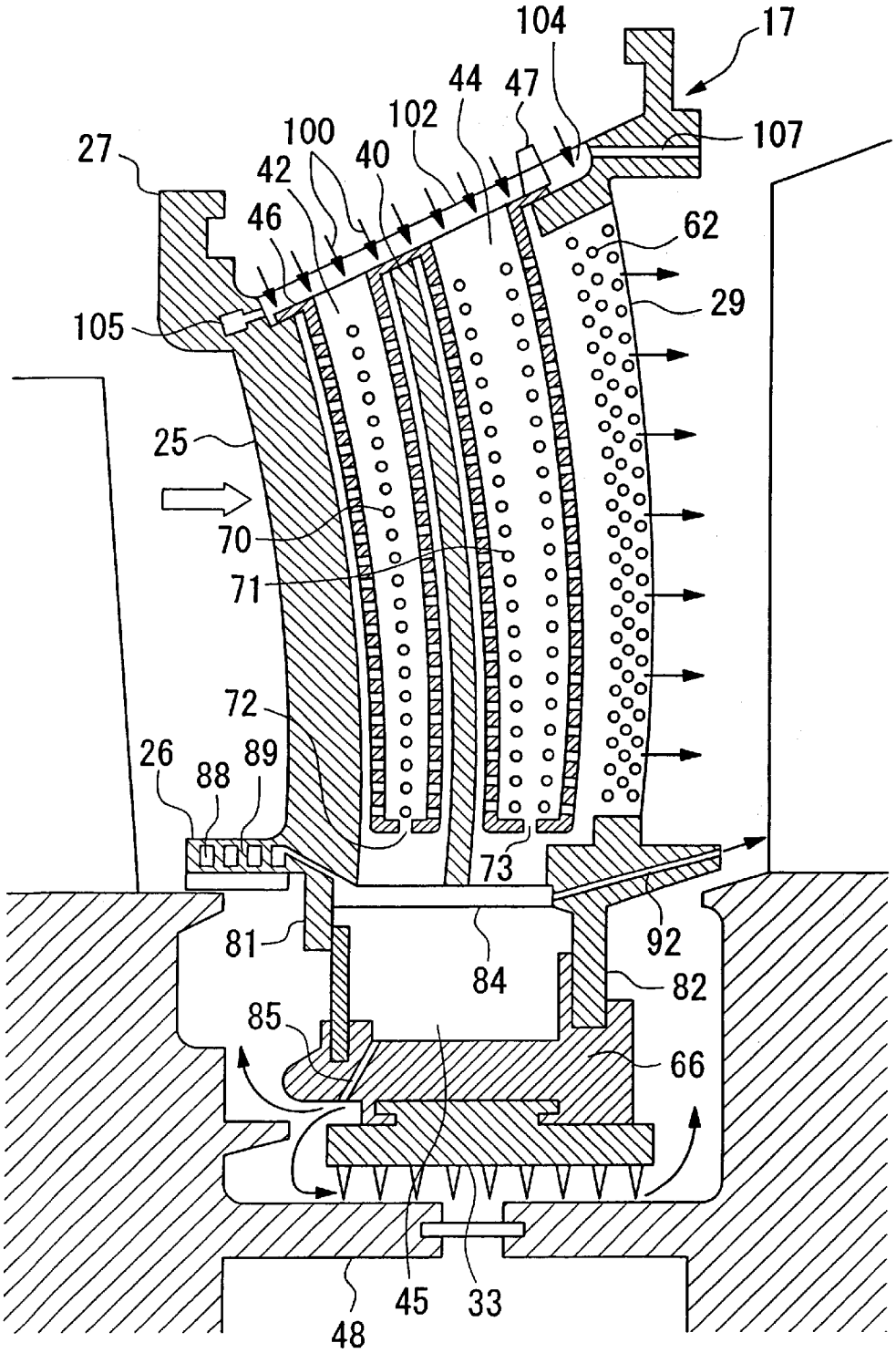
FIG. 5 BACKGROUND ART
FIG. 5 is a cross-sectional view of a stationary blade for explaining a conventional cooling structure of a stationary blade.
Figure 6:
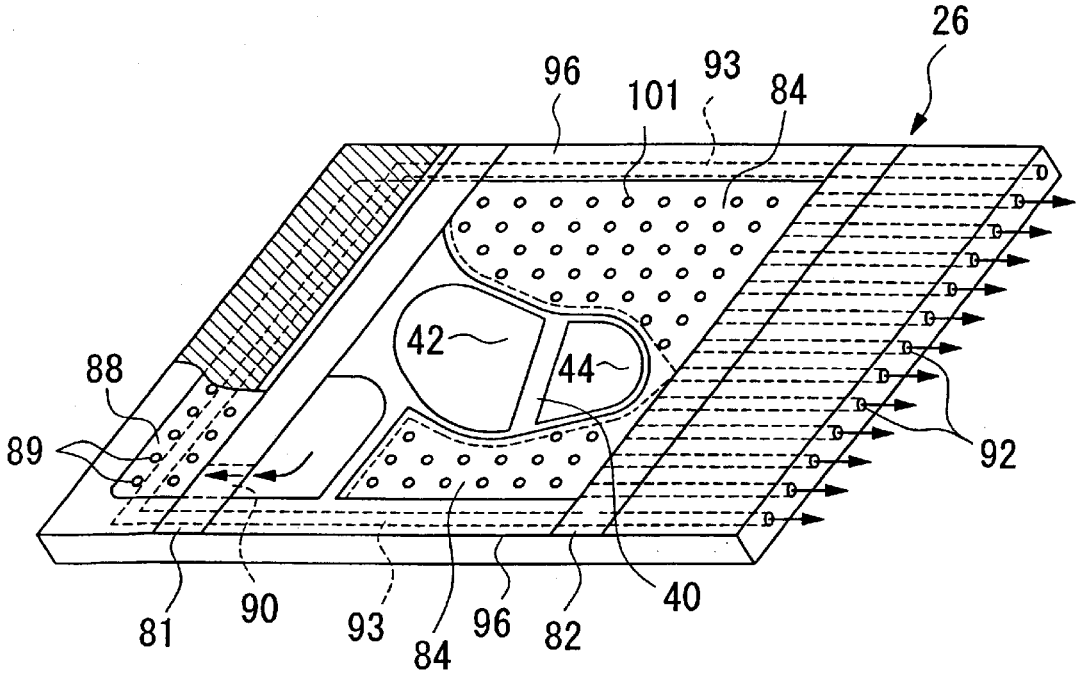
FIG. 6 BACKGROUND ART
FIG. 6 is a perspective view of a conventional inner shroud shown from the bottom surface of the inner shroud for explaining the inner shroud of a stationary blade.
Figure 7:
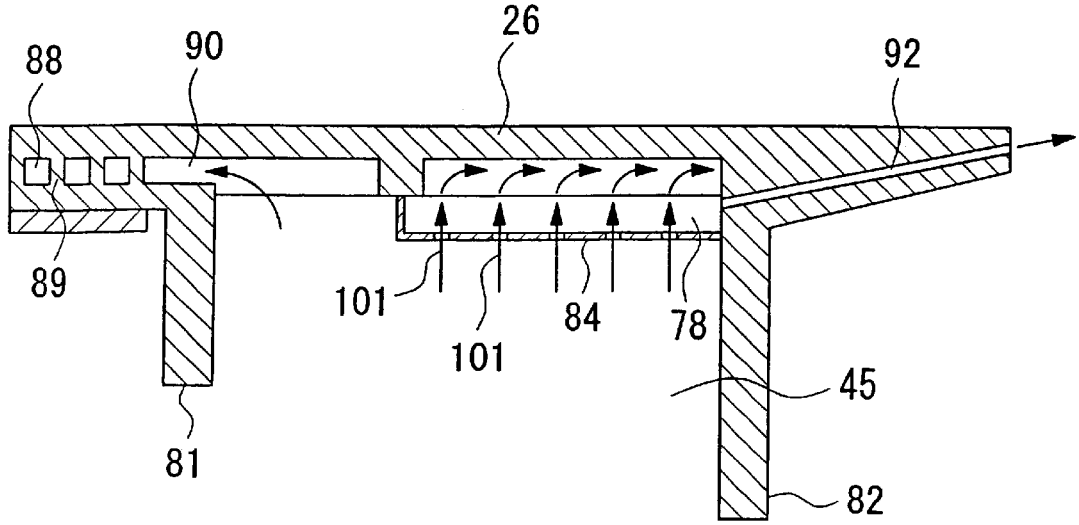
FIG. 7 BACKGROUND ART
FIG. 7 is a cross-sectional view of a conventional inner shroud for explaining the inner shroud of a stationary blade.
Figure 8:
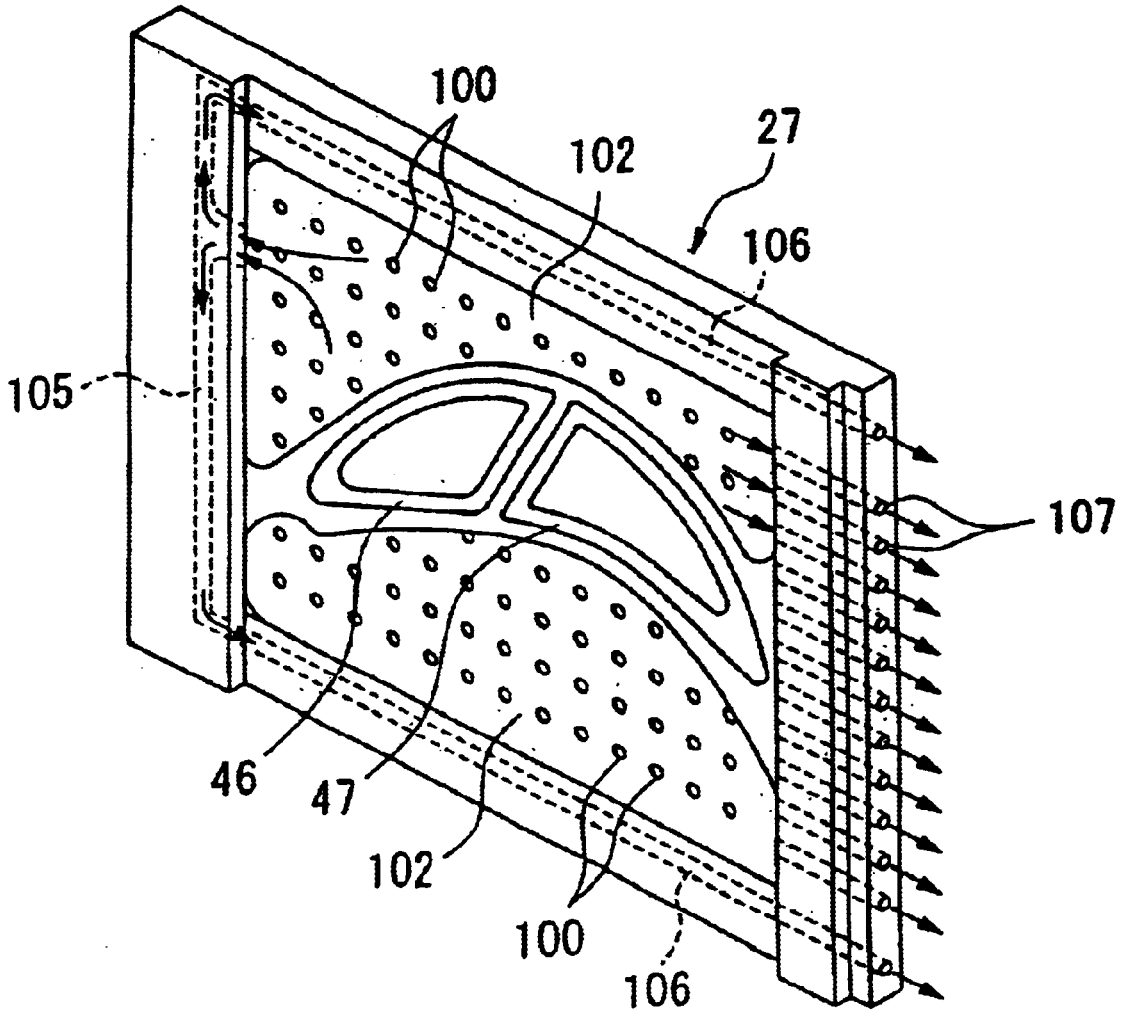
FIG. 8 PRIOR ART
FIG. 8 is a perspective view of a conventional outer shroud shown from the upper surface of the outer shroud for explaining the outer shroud of a stationary blade.

Furthermore, one trailing edge flow path 127 is provided in outer shroud 27 according to the above example. However, plural trailing edge flow paths 127 may be provided, as shown in FIG. 3A, at intervals in the width direction of outer shroud 27. According to this structure, the trailing edge of outer shroud 27 can be uniformly cooled in the width direction together with cooling on header 125.

What is claimed is:

1. A cooling structure of a stationary blade, comprising:

an inner shroud and an outer shroud at an inside and an outside of said blade, in which the outer shroud, the blade, and the inner shroud are cooled by cooling air to be sent to the outer shroud side, wherein a cavity is formed at an inner surface of the inner shroud into which cooling air passing through the blade is sent, and the inner shroud comprises:

a collision plate having plural small holes provided at an interval from a bottom surface of the inner shroud to form a chamber therein, said collision plate configured to guide the cooling air from the cavity through a region of the chamber on a central axis of the inner shroud to a leading edge side of the collision plate;

a leading edge flow path provided at the leading edge side of said collision plate along a width direction for guiding the cooling air in the chamber;

a side flow path provided along both sides of said collision plate for guiding the cooling air in the leading edge flow path to a trailing edge side;

a header formed along the width direction near the trailing edge for feeding the cooling air from the side flow path; and plural trailing edge flow paths formed at intervals along the width direction at the trailing edge side each having one end connected to the header and the other end being open at the trailing edge, for ejecting the cooling air in the header from the trailing edge.

2. A cooling structure of a stationary blade according to claim 1, wherein the outer shroud comprises:

a collision plate having plural small holes, provided at an interval from an upper surface of the outer shroud to form a chamber between the upper surface and the collision plate, said collision plate configured to guide said cooling air to a leading edge side of the collision plate of the outer shroud;

a leading edge flow path provided at the leading edge side of said collision plate along a width direction for guiding the cooling air in the chamber;

a side flow path provided along both sides of said collision plate for guiding the cooling air in the leading edge flow path to a trailing edge side;

a header formed along the width direction near the trailing edge for feeding the cooling air from the side flow path; and plural trailing edge flow paths formed at intervals along the width direction at the trailing edge side each having one end connected to the header and the other end being open at the trailing edge, for ejecting the cooling air in the header from the trailing edge.

3. A cooling structure of a stationary blade according to claim 2, wherein plural trailing edge flow paths of the outer shroud are provided along the width direction at predetermined intervals.

4. A cooling structure of a stationary blade, comprising:

an inner shroud and an outer shroud at an inside and an outside of said blade, in which the outer shroud, the blade, and the inner shroud are cooled by cooling air to be sent to the outer shroud side, wherein the outer shroud comprises;

a collision plate having plural small holes provided at an interval from an upper surface of the outer shroud to form a chamber therein, said collision plate configured to guide the cooling air through a region of the chamber on a central axis of the outer shroud to a leading edge side of the collision plate of the outer shroud;

a leading edge flow path provided at the leading edge side of the collision plate of the outer shroud along a width direction for guiding the cooling air in the chamber;

a side flow path provided along both sides of the collision plate of the outer shroud for guiding the cooling air in the leading edge flow path to a trailing edge side;

a header formed along the width direction near the trailing edge for feeding the cooling air from the side flow path; and one or more trailing edge flow paths formed at intervals along the width direction at the trailing edge side each having one end connected to the header and the other end being open at the trailing edge, for ejecting the cooling air in the header from the trailing edge.

5. A cooling structure of a stationary blade according to claim 4, wherein plural trailing edge flow paths of the outer shroud are provided along the width direction at predetermined intervals.

6. A gas turbine having a cooling structure of a stationary blade according to any one of claims 1 to 5, wherein a stationary blade comprises a turbine which rotates a rotor by combustion gas from a combustor.

* * * * *

UNITED STATES PATENT AND TRADEMARK OFFICE

CERTIFICATE OF CORRECTION

PATENT NO. : 6,761,529 B2
DATED : July 13, 2004
INVENTOR(S) : Soechting et al.

It is certified that error appears in the above-identified patent and that said Letters Patent is hereby corrected as shown below:

Title page,
Item [73], Assignee, should read:
-- Mitsubishi Heavy Industries, Ltd., Tokyo (JP) --.

Signed and Sealed this

Seventeenth Day of January, 2006

JON W. DUDAS
*Director of the United States Patent and Trademark Office*